United States Patent [19]

Glomb et al.

[11] Patent Number: 4,710,132

[45] Date of Patent: Dec. 1, 1987

[54] ELECTRICAL PLUG CONNECTOR STRIP

[75] Inventors: Kurt Glomb, Germering; Heinz Niggl, Poecking; Leo Pelzl, Holzkirchen; Karl Zell, Niederpoecking, all of Fed. Rep. of Germany

[73] Assignee: Siemens Aktiengesellschaft, Berlin and Munich, Fed. Rep. of Germany

[21] Appl. No.: 783,112

[22] Filed: Oct. 2, 1985

[30] Foreign Application Priority Data

Nov. 12, 1984 [DE] Fed. Rep. of Germany ..... 3441310

[51] Int. Cl.[4] ..... H01R 9/09

[52] U.S. Cl. ..... 439/79; 403/406.1

[58] Field of Search ..... 339/17 LC, 17 L, 17 CF, 339/125 R, 126 RS, 132 R, 132 B; 411/188, 508–510, 907, 908; 403/406.1, 407.1, 405.1

[56] References Cited

U.S. PATENT DOCUMENTS

| | | | |
|---|---|---|---|
| 2,976,345 | 3/1961 | Whitted | 411/508 |
| 3,000,066 | 9/1961 | Cochran | 411/908 |
| 3,319,918 | 5/1967 | Rapata | 411/510 |
| 3,636,503 | 1/1972 | Bernutz et al. | 339/17 LC |
| 4,050,769 | 9/1977 | Ammon | 339/196 M |
| 4,477,142 | 10/1984 | Cooper et al. | 339/125 R |

*Primary Examiner*—Neil Abrams

*Attorney, Agent, or Firm*—Hill, Van Santen, Steadman & Simpson

[57] ABSTRACT

The invention relates to an electrical plug connector strip provided with a plurality of rows of contact elements that are connected by means of terminal elements to a printed circuit board of an electrical assembly, whereby the sections of the terminal elements projecting from receptacle chambers for the contact elements are bent toward the printed circuit board. In order to obtain a simple, firm connection between the electrical plug connector strip and the printed circuit board, the back side of the plug connector strip contains a plurality of flanges having downwardly directed insertion posts. Preferably two posts are provided, one larger in diameter and length than the other. A groove is provided around each post on the underside of the flange to receive chips of the post which are cut off during the insertion process. A pinch rib may be provided on the connector strip to engage the circuit board and provide a tight fit.

1 Claim, 2 Drawing Figures

ELECTRICAL PLUG CONNECTOR STRIP

BACKGROUND OF THE INVENTION

1. Field of the Invention

The invention relates to an electrical plug connector strip provided with a plurality of rows of contact elements which are connected by means of terminal elements to a printed circuit board of an electrical assembly.

2. Description of the Prior Art

It is known from U.S. Pat. No. 4,050,769 to secure such electrical plug connector strips to the printed circuit board with the assistance of screw-type connections. The way of fastening plug connector strip and printed circuit board requires a considerable outlay in terms of cost and labor in the manufacture of printed circuit boards connected to plug connector strips.

SUMMARY OF THE INVENTION

An object of the invention is to provide a plug connector strip of the above type with which a firm connection to the printed circuit board can be achieved in a simple and inexpensive way.

This object is achieved in accord with the invention for an electrical plug connector strip of the type described in that the back side of the plug connector strip contains a plurality of flanges with downwardly directed insertion posts.

With the provision of corresponding bores in the printed circuit board to receive the posts, it is thus possible to firmly connect the plug connector strip of the invention to the printed circuit board without special screwing work. This plugging operation ensues simultaneously with the plugging operation for the terminal elements, so that at least one work step can be eliminated.

A development of the plug connector strip of the invention is characterized in that two insertion posts are provided per flange, whereby the insertion post closest to the strip member has a larger diameter and a greater length in comparison to the second insertion post. A certain preguidance of the plug connector strip member to the printed circuit board is thereby achieved. Simultaneously guaranteed due to the dimensioning of the larger insertion post providing the preguidance function is that the high plug-in forces initially occurring during a plugging operation can be reliably absorbed by the insertion post. The second insertion post at the flange then only serves the purpose of final positioning.

Another development of the plug connector strip of the invention is characterized in that cavities are provided in the flanges of the plug connector strip adjacent to the insertion posts on the underside of the flanges. These cavities serve for collecting chips from the posts that can arise due to the prescribed tolerances when plugging the plug connector strip into the printed circuit board. An exact, planar lie of the flange on the printed circuit board is thus assured.

An expedient development of the plug connector strip of the invention is characterized in that the cavities are essentially designed as annular grooves whose inside diameter corresponds to the diameter of the respectively allocated insertion post. It is thus guaranteed that potentially arising chips can be collected over the entire circumference of the insertion post.

Another advantageous development of the plug connector strip of the invention is characterized in that a pinch rib having a triangular cross section is fashioned on the strip member opposite every insertion post adjoining the strip member, the cross section of this pinch rib being enlarged in the direction toward the underside of the flange. A tolerance compensation between the actual body of the plug connector strip and the printed circuit board is thus created. At the same time, the plug in force is thereby also transmitted onto the body of the plug connector and is intercepted by it.

BRIEF DESCRIPTION OF THE DRAWINGS

The invention shall be explained in greater detail below with reference to an exemplary embodiment shown in the drawings.

DESCRIPTION OF THE PREFERRED EMBODIMENTS

Figure 1:
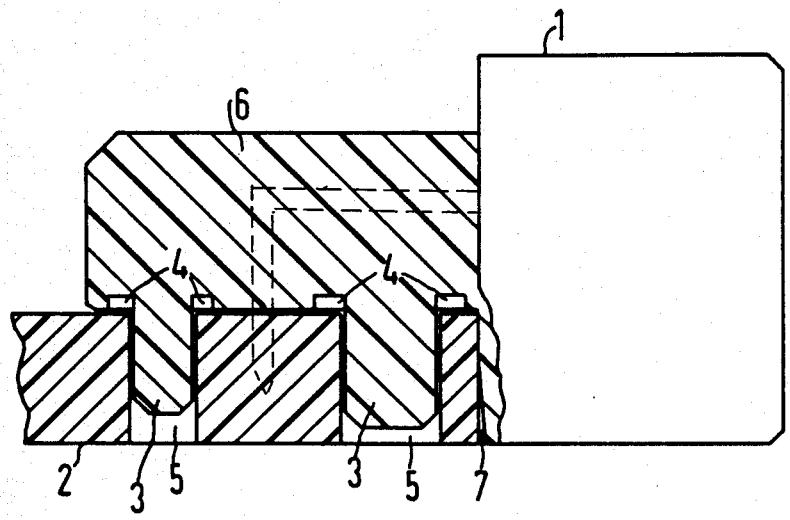
FIG. 1 shows a partial cross section through a flange of a plug connector strip as well as the appertaining cross section through a printed circuit board. The majority part of the body of the plug connector strip is thereby shown in elevation in order to simplify the illustration.
Figure 2:
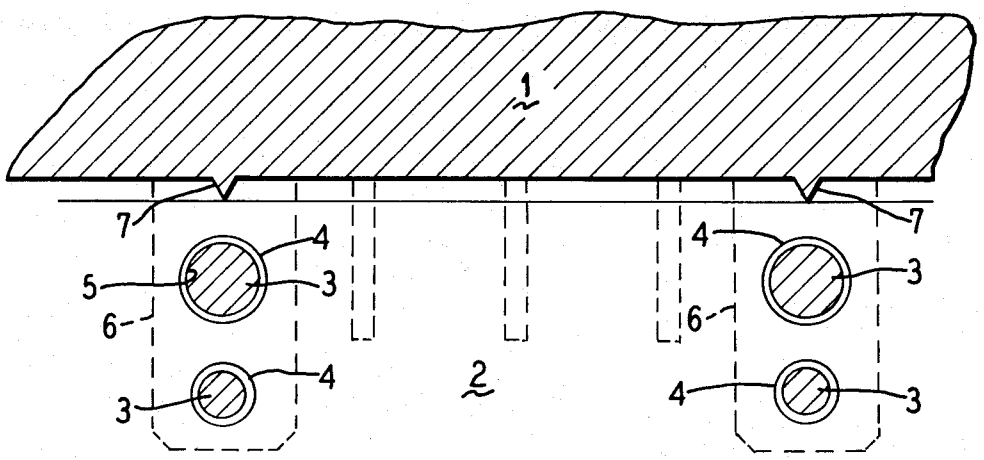
FIG. 2 is a plan view of the connector strip of FIG. 1 shown mounted on the circuit board.

The single-piece contact elements composed of contact springs and terminal elements that are held in chambers of the plug connector strip and produce the contact to the printed circuit board are not shown in the drawings since they are not essential to the invention. As initially stated, an object of the invention is to firmly connect a plug connector strip 1 to a printed circuit board 2. To this end, the plug connector strip 1 contains a plurality of arbitrarily distributed flanges 6 that are each provided with insertion posts 3. In the illustrated exemplary embodiment, two insertion posts are provided per flange. As illustrated in the drawings, the insertion post 3 closest to the plug connector strip 1 has larger dimensions. That is, this insertion post 3 has a larger diameter and a greater length. A certain preguidance for the flange 6 to the printed circuit board 2 is thereby achieved. The insertion post assuming the pre-guidance is dimensioned larger because considerable forces can arise during the plug-in operation, particularly at the beginning. The second insertion post mainly serves the purpose of a final fixing or positioning of the plug connector strip with respect to the printed circuit board 2. The bores needed in the printed circuit board 2 for the acceptance of the insertion post 3 are referenced 5.

Due to the prescribed tolerances between the diameter of the insertion posts and the diameter of the bores 5, chips from the posts 3 can arise due to a cut during the plug-in operation. These chips would deposit between the printed circuit board 2 and the underside of the flange 6 and would prevent a planar lie of the flange 6 on the printed circuit board 2. In order to avoid this, cavities 4 are provided adjacent to the insertion posts at the underside of the flange 6. These serve for collecting a chip that may arise. These cavities are expediently fashioned such that they can collect chips that occur over the entire circumference of the insertion post. The simplest fashion would be to design these cavities as circular grooves, whereby the inside diameter of these grooves corresponds to the diameter of the insertion posts 3. The outer limitation of the cavities 4, however, definitely need not have a circular shape.

In order to enable a firm lie of the printed circuit board 2 against the actual body of the plug connector strip despite existing tolerances, pinch ribs 7 are provided at the strip body opposite each insertion post directly adjoining the strip body. These pinch ribs have a triangular cross section that enlarges in the direction toward the underside of the flange 6. In addition to a firm lie of the printed circuit board 2 against the body of the plug connector strip, the pinch ribs 7 also simultaneously achieve the result that the plugging force is also transmitted onto the body of the plug connector strip 1 and is partly intercepted and absorbed by the plug connector strip 1.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. In an electrical plug connector strip provided with a plurality of rows of contact elements that are connected by means of terminal elements to a printed circuit board of an electrical assembly, the improvement comprising:

a plurality of flanges having downwardly directed insertion posts provided on the back side of said plug connector strip to engage in bores in said circuit board;

engagement means between said strip and said circuit board to provide increasing engagement between said strip and said circuit board upon insertion of said posts into said bores, whereby said plug connector strip can be secured to said circuit board by means of a plugging operation;

two of said insertion posts being provided per flange, said insertion post closest to the plug connector strip body has a larger diameter and a greater length in comparison to the second insertion post; and said engagement means comprising a pinch rib having a triangular cross section fashioned on the strip body opposite every insertion post positioned closest to said strip body, the cross section of said pinch rib enlarging in the direction toward the underside of said flange to increasingly engage a forward edge of said circuit board as said connector strip is engaged into said circuit board.

* * * * *